US009022815B2

(12) United States Patent
Kim

(10) Patent No.: US 9,022,815 B2
(45) Date of Patent: May 5, 2015

(54) CONNECTING TERMINAL FOR STORAGE BATTERY

(71) Applicant: Chang Hwan Precision Terminal Co., Ltd., Dangjin-gun (KR)

(72) Inventor: Hwan Chang Kim, Yongin-si (KR)

(73) Assignee: Chang Hwan Precision Terminal Co., Ltd., Dangjin-Gun (KR)

( * ) Notice: Subject to any disclaimer, the term of this patent is extended or adjusted under 35 U.S.C. 154(b) by 178 days.

(21) Appl. No.: 13/740,537

(22) Filed: Jan. 14, 2013

(65) Prior Publication Data

US 2014/0134896 A1 May 15, 2014

(30) Foreign Application Priority Data

Nov. 15, 2012 (KR) ..... 10-2012-0129472

(51) Int. Cl.
*H01R 4/42* (2006.01)
*H01R 11/28* (2006.01)

(52) U.S. Cl.
CPC ..... *H01R 11/281* (2013.01); *H01R 11/283* (2013.01)

(58) Field of Classification Search
CPC .. H01R 11/281; H01R 11/283; H01R 11/282; H01R 11/285; H01R 11/287
USPC ..... 439/762, 758
See application file for complete search history.

(56) References Cited

U.S. PATENT DOCUMENTS 1,230,394 A * 6/1917 Ford ..... 429/158
1,383,845 A * 7/1921 Palmer, Jr. ..... 439/218
1,522,728 A * 1/1925 Krohn ..... 439/762
1,655,598 A * 1/1928 Diller ..... 439/754
1,886,095 A * 11/1932 Hamby ..... 439/769
1,945,437 A * 1/1934 Krueger ..... 439/770
1,980,779 A * 11/1934 Benny ..... 439/756
2,043,512 A * 6/1936 Hoover ..... 439/519
2,285,545 A * 6/1942 Wagner et al. ..... 439/759
2,769,964 A * 11/1956 Lartz ..... 439/757
2,962,689 A * 11/1960 La Rue Johnson et al. .. 439/388
4,751,049 A * 6/1988 Shannon ..... 420/477
5,183,419 A * 2/1993 Dewar ..... 439/765
5,498,178 A * 3/1996 Tabata ..... 439/762
5,547,403 A * 8/1996 Haberstroh et al. ..... 439/763
6,234,849 B1 * 5/2001 Blanche ..... 439/764

(Continued)

FOREIGN PATENT DOCUMENTS

KR 10-0821591 4/2008
KR 10-0821595 4/2008

(Continued)

*Primary Examiner* — Abdullah Riyami
*Assistant Examiner* — Vladimir Imas
(74) *Attorney, Agent, or Firm* — Harness, Dickey & Pierce, P.L.C.

(57) ABSTRACT

The storage battery connection terminal comprising: an insertion unit formed in a shape of a curved; a clamping unit formed by extending end portions of the insertion; and a power withdrawal unit formed to be extended from the other end portion of the insertion unit, in which the insertion unit, the clamping unit and the power withdrawal unit are manufactured by molding a single panel. The clamping unit includes a lower plate formed to be inclined by extending one end portion of the insertion unit so as to support the clamping bolt, and an upper plate formed to be inclined by extending the other end portion of the insertion unit so as to be disposed in parallel to the lower plate, on which the clamping nut is rested.

10 Claims, 7 Drawing Sheets

(56) References Cited

U.S. PATENT DOCUMENTS

| | | | | |
|---|---|---|---|---|
| 6,623,315 | B1 * | 9/2003 | Roderick | 439/772 |
| 7,381,101 | B2 * | 6/2008 | Roset et al. | 439/754 |
| 7,445,525 | B2 * | 11/2008 | Kosuge | 439/762 |
| 7,500,888 | B2 * | 3/2009 | Roset et al. | 439/754 |
| 8,142,237 | B2 * | 3/2012 | Condamin et al. | 439/762 |
| 8,310,241 | B2 * | 11/2012 | Schimmel | 324/437 |
| 8,317,549 | B2 * | 11/2012 | Falchetti | 439/762 |

FOREIGN PATENT DOCUMENTS

| | | | |
|---|---|---|---|
| KR | 20-0442760 | | 12/2008 |
| KR | 200442760 | Y1 * | 12/2008 |
| KR | 10-1188637 | | 9/2012 |

* cited by examiner

CONNECTING TERMINAL FOR STORAGE BATTERY

CROSS-REFERENCE TO RELATED APPLICATION

This application claims the benefit and priority of Korean Patent Application No. 10-2012-0129472, filed Nov. 15, 2012. The entire disclosure of the above application is incorporated herein by reference.

BACKGROUND OF THE INVENTION

1. Field of the Invention

The present invention relates to a storage battery connection terminal for connecting a storage battery of a vehicle to a connection terminal, and particularly, to a storage battery connection terminal formed by processing a single panel, in which a clamping nut is coupled from an inclined or top direction, not a lateral direction, so that a connection work can be easily performed avoiding obstructions of neighboring devices.

2. Background of the Related Art

Generally, diverse electrical devices are installed in a vehicle, and thus a means for supplying electricity to the electrical devices is required. Accordingly, an alternator which generates electricity when a vehicle engine starts is installed in the vehicle, and power is supplied to the various electrical devices.

However, if the vehicle engine rotates more than a predetermined number of times, more electricity than power consumption is generated, and if the engine stops or rotates at a low speed, the consumed power can be larger than the generated electricity. Accordingly, a storage battery is additionally installed in a vehicle in order to store surplus electricity and supplement lacking electricity.

The storage battery has two cylindrical post terminals of a (+) terminal and a (−) terminal, and connection terminals are used to safely withdraw power from the post terminals regardless of vibrations of the vehicle.

As shown in FIG. 1, a general storage battery connection terminal includes a power withdrawal unit 120 formed in a plate shape and provided with a connection hole of a predetermined size at the center, a connection bolt 130 inserted into the connection hole provided at the center of the power withdrawal unit 120, an insertion unit 140 provided at one side of the power withdrawal unit 120 and formed in a circular shape with an open side so as to insert a post terminal of a storage battery (not shown), and a clamping unit 150 formed at one side of the insertion unit 140 to be symmetrical in the horizontal direction.

The clamping unit 150 is provided with clamping holes at the front and rear in order to adjust the diameter of the insertion unit 140 using a clamping bolt 151 and a clamping nut 152. In addition, a hollow fixing drum is provided between the clamping bolt 151 and the clamping nut 152 in order to prevent excessive deformation of the insertion unit 140.

In addition, a storage battery connection terminal 100 of the prior art includes a connection terminal 170 where connection wires (not shown) connected in series or in parallel to supply power to the vehicle from the storage battery are installed. A connection hole where the connection bolt 130 is inserted is formed at one side of the connection terminal 170, and the fixing nut 131 is engaged with the connection bolt 130 and combined with the power withdrawal unit 120, in which the connection bolt 130 is projected passing through the connection hole of the connection terminal 170 with the intervention of a washer 132.

However, in the storage battery connection terminal 100 of the prior art, since the clamping bolt is positioned on the lateral side of the storage battery, workers suffer from difficulties in performing a connection work, and the workers are obstructed by other parts in the vehicle in using a clamping tool.

Storage battery connection terminals are developed in order to solve the obstruction problem, in which clamping bolts are installed in an inclined or vertical direction so that a work of coupling a clamping nut can be easily performed with a clamping tool, and these are disclosed in the patent documents listed below.

(Patent document 1) KR20-0442760 Y1
(Patent document 2) KR10-0821591 B1
(Patent document 3) KR10-0821595 B1
(Patent document 4) KR10-1188637 B1

However, the storage battery connection terminals of the prior art are disadvantageous in that upper edges of a clamping bolt are damaged to prevent an engaged clamping nut from being loosened, and thus the clamping bolt is corroded.

SUMMARY OF THE INVENTION

Therefore, the present invention has been made in view of the above problems, and it is an object of the present invention to provide a storage battery connection terminal, in which durability is improved by preventing corrosion of a clamping bolt while making it easy to couple a clamping nut using a clamping tool.

In addition, another object of the present invention is to provide a storage battery connection terminal, in which inclined upper and lower plates are arranged in parallel, and thus damages to a post terminal caused by excessive tightening can be prevented, and clamping force applied to the post terminal can be improved.

In addition, another object of the present invention is to provide a storage battery connection terminal, in which strength of a neck part connecting an insertion unit and a power withdrawal unit is improved through a bending process, and thus durability of the product can be improved.

In addition, another object of the present invention is to provide a storage battery connection terminal, in which a position of a connection terminal connected to a power withdrawal unit can be easily set, and thus the connection terminal may stably maintain the connection state.

To accomplish the above object, according to one aspect of the present invention, there is provided a storage battery connection terminal including: an insertion unit formed to be curved in a cylindrical shape so that a post terminal of a storage battery may be inserted and combined; a clamping unit formed by extending end portions of the insertion unit toward outside so as to combine or separate the insertion unit to or from the post terminal by adjusting the diameter of the insertion unit as a gap in the clamping unit is changed depending on a position where a clamping bolt and a clamping nut are engaged; and a power withdrawal unit formed to be extended from the other end portion of the insertion unit and provided with a connection bolt to which a connection terminal for withdrawing power to outside is connected, in which the insertion unit, the clamping unit and the power withdrawal unit are manufactured by molding a single panel. Here, the clamping unit includes a lower plate formed to be inclined by extending one end portion of the insertion unit so as to support a head part of the clamping bolt, and an upper plate formed to be inclined by extending the other end portion of the insertion unit so as to be spaced apart from the lower plate and disposed in parallel to the lower plate, on which the clamping nut is rested. Bolt fixing pieces for fixing the head of the clamping bolt are formed to be integrated with the lower plate by bending both width direction ends of the lower plate downward. A guide piece is formed to be integrated with the upper plate by bending one width direction upper end of the upper plate downward so as to prevent the clamping nut not to be tightened further more when the upper plate and the lower plate are stably contacted and a contacting force arrive at a threshold value.

In addition, according to the storage battery connection terminal of the present invention, a silicon coating layer is formed on an inner surface of the clamping nut.

In addition, according to the storage battery connection terminal of the present invention, a plurality of clamping projections is formed on an inner surface of the insertion unit at regular intervals along a height direction.

In addition, according to the storage battery connection terminal of the present invention, a neck part connecting the insertion unit and the power withdrawal unit is preferably bent to be inclined upward and bent again in a horizontal direction to have a z-bending structure.

In addition, according to the storage battery connection terminal of the present invention, the power withdrawal unit includes rotation prevention pieces, both width direction ends of which are bent downward to prevent rotation of the connection bolt, and fixing pieces bent toward from a middle of the rotation prevention piece to a bottom of the connection bolt to support the connection bolt.

In addition, according to the storage battery connection terminal of the present invention, the power withdrawal unit is further provided with a bit hole formed by pressing an outer bottom surface of the rotation prevention piece and a position determination projection protruded toward a top surface in correspondence to the bit hole.

In addition, according to the storage battery connection terminal of the present invention, the clamping bolt is installed to penetrate the lower plate and the upper plate in a direction perpendicular to a plate surface of the lower plate and to be inclined with respect to the insertion unit, and the clamping nut is engaged with the clamping bolt in an inclined direction with respect to the insertion unit, in which a reinforce unit is prominently formed from a lower portion of the upper plate toward the top surface of the upper plate to improve strength of the upper plate and restrict movement of the clamping nut.

In addition, according to the storage battery connection terminal of the present invention, the bolt fixing piece includes a rotation preventing piece for restricting rotation of the clamping bolt and a fixing piece bent down from a middle of the rotation piece to a position below the clamping bolt to fix the clamping bolt.

In addition, according to the storage battery connection terminal of the present invention, the clamping bolt is installed to be perpendicular to a bottom surface so that a body of the clamping bolt may penetrate the lower plate and the upper plate, and the clamping nut is engaged with the clamping bolt with intervention of a beveled washer between the upper plate and the clamping nut so that the clamping nut can be engaged with the clamping bolt from a direction perpendicular to the bottom surface.

In addition, according to the storage battery connection terminal of the present invention, a head of the clamping bolt is formed to be inclined so that a bottom surface to which the body is connected can be surface-contacted with a bottom surface of the lower plate, and a top surface of the head is formed as a curved surface so as to be fixed by the bent bolt fixing piece, wherein the beveled washer is formed such that a portion contacting with the upper plate is formed as an inclined surface, and a surface contacting with the clamping nut is formed as a horizontal surface.

In addition, according to the storage battery connection terminal of the present invention, the storage battery connection terminal further comprises a washer rotation prevention piece formed by bending an end of the upper plate upward to prevent departure of the beveled washer.

Figure 1:
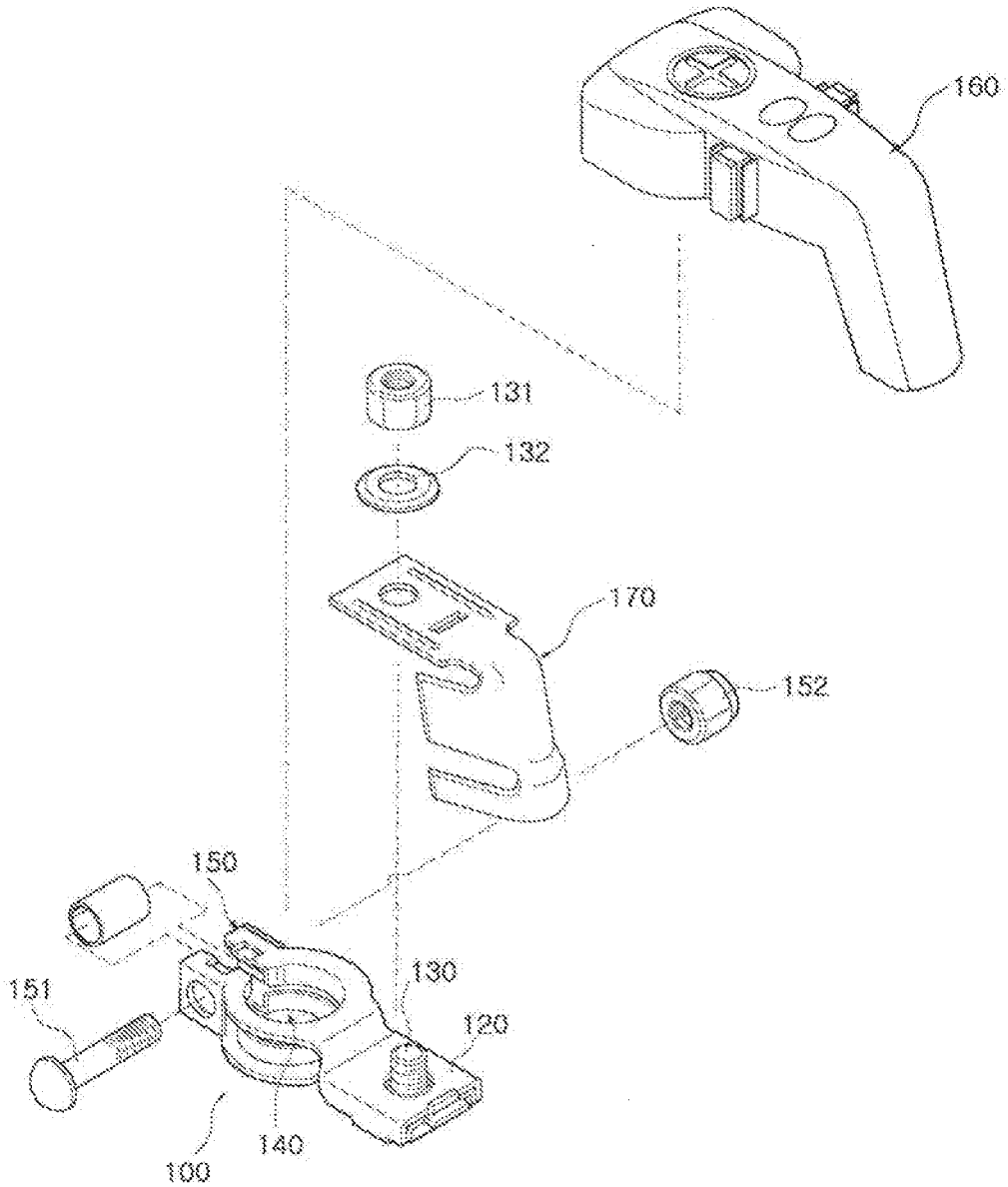
FIG. 1 PRIOR ART
FIG. 1 an exploded perspective view showing a storage battery connection terminal of the prior art.
Figure 2:
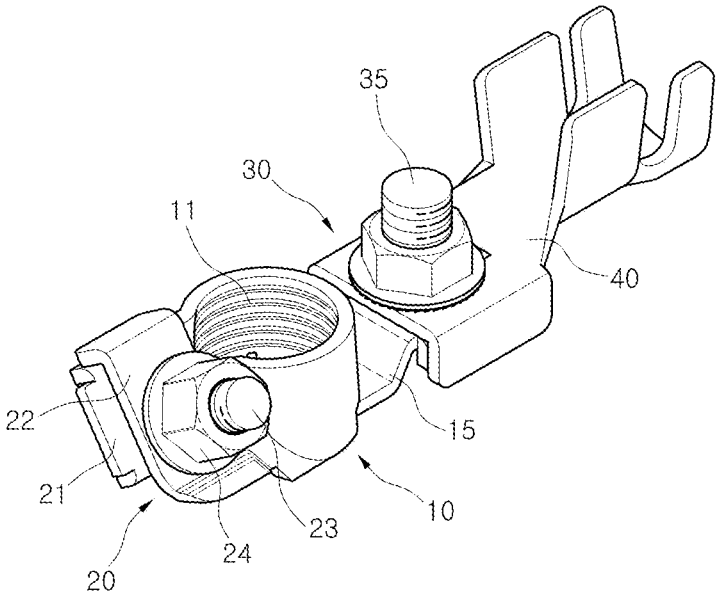
FIG. 2 is a perspective view showing a storage battery connection terminal according to the present invention.
Figure 3:
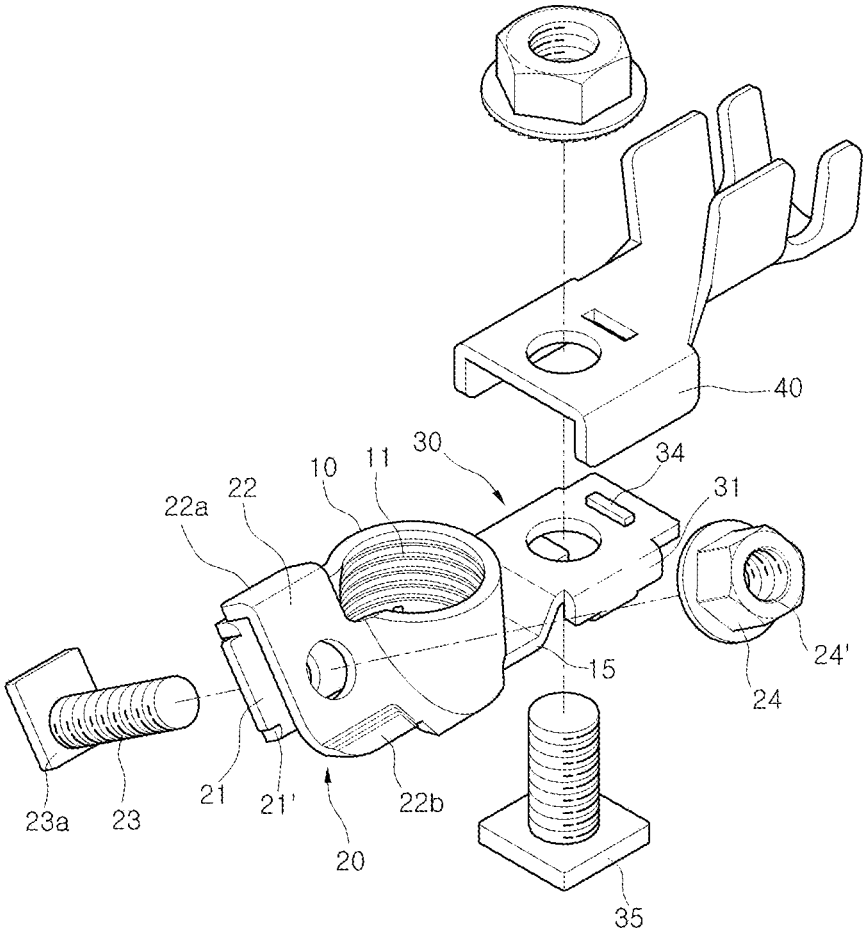
FIG. 3 an exploded perspective view showing a storage battery connection terminal of the present invention.
Figure 4:
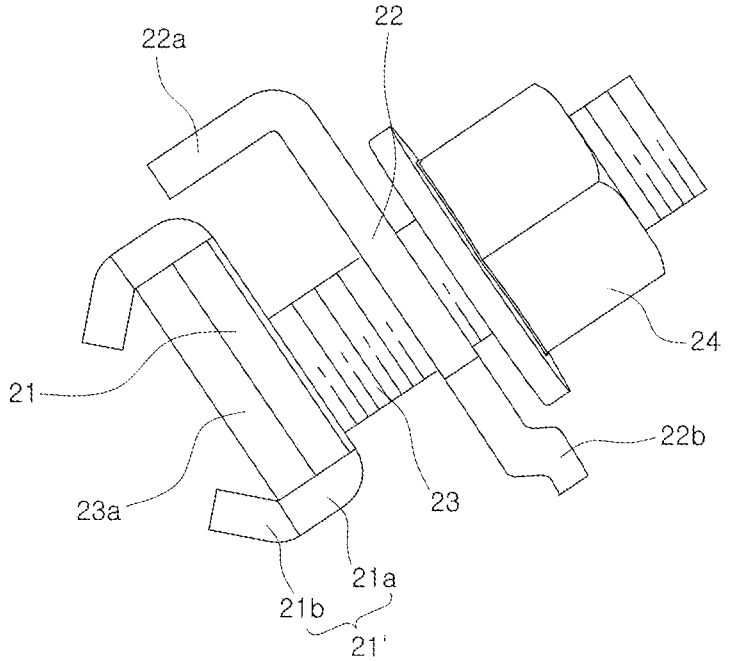
FIG. 4 is a side view showing a clamping unit which is an important part of the present invention.
Figure 5:
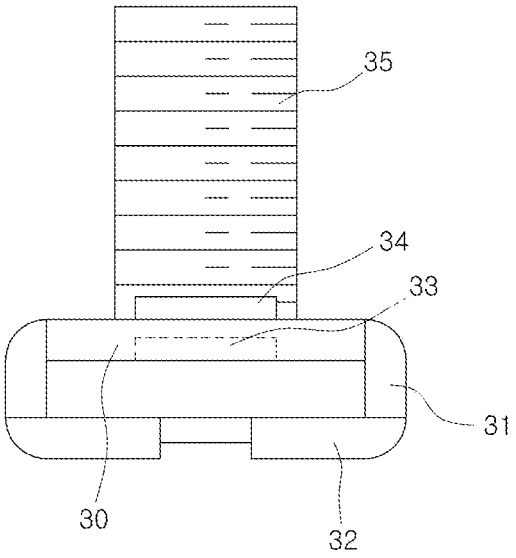
FIG. 5 is a side view showing a power withdrawal unit which is an important part of the present invention.
Figure 6:
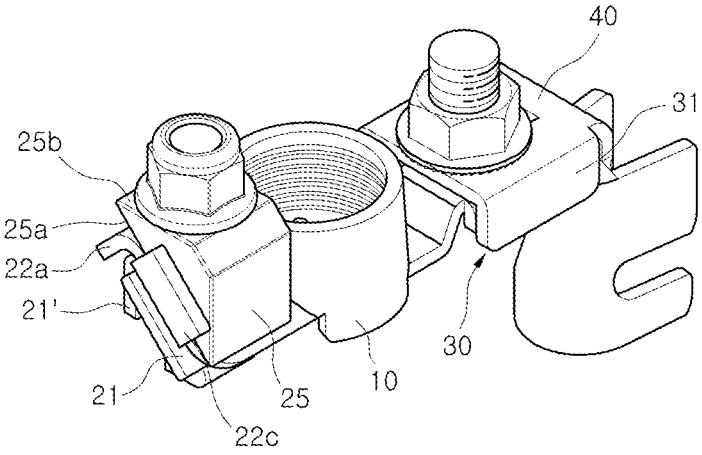
FIG. 6 is a perspective view showing another embodiment of the present invention.

| DESCRIPTION OF SYMBOLS | |
|---|---|
| 10: Insertion unit | 11: Clamping projection |
| 15: Neck part | 20: Clamping unit |
| 21: Lower plate | 21': Bolt fixing piece |
| 21a: Rotation prevention piece | 21b: Lower fixing piece |
| 22: Upper plate | 22a: Guide piece |
| 22b: Reinforce unit | |
| 22c: Washer rotation prevention piece | |
| 23: Clamping bolt | 23': Clamping bolt |
| 23a: Head | 23b: Body |
| 24: Clamping nut | |
| 24': Silicon coating layer | |
| 25: Beveled washer | 25a: Inclined surface |
| 25b: Horizontal surface | 30: Power withdrawal unit |
| 31: Rotation prevention piece | 32: Fixing piece |
| 33: Bit hole | |
| 34: Position determination projection | |
| 35: Connection bolt | 40: Connection terminal |

DETAILED DESCRIPTION OF THE PREFERRED EMBODIMENT

A storage battery connection terminal of the present invention will be hereafter described in detail with reference to the accompanying drawings.

As shown in FIGS. 2 to 6, the storage battery connection terminal according to the present invention includes an insertion unit 10 formed in the shape of a curved cylinder so that a post terminal of a storage battery may be inserted and combined; a clamping unit 20 formed by extending end portions of the insertion unit 10 toward outside so as to combine or separate the insertion unit 10 to or from the post terminal by adjusting the diameter of the insertion unit 10 as a gap in the clamping unit is changed depending on a position where a clamping bolt 23 and a clamping nut 24 are engaged; and a power withdrawal unit 30 formed to be extended from the other end portion of the insertion unit 10 and provided with a connection bolt 35 to which a connection terminal 40 for withdrawing power to outside is connected, and the insertion unit 10, the clamping unit 20 and the power withdrawal unit 30 are manufactured by molding a single panel.

Here, the clamping unit 20 includes a lower plate 21 formed to be inclined by extending one end portion of the insertion unit 10 so as to support a head part 23*a* of the clamping bolt 23, and an upper plate 22 formed to be inclined by extending the other end portion of the insertion unit 10 so as to be spaced apart from the lower plate 21 and disposed in parallel to the lower plate, on which the clamping nut 24 is rested. Bolt fixing pieces 21' for fixing the head 23*a* of the clamping bolt 23 are formed to be integrated with the lower plate 21 by bending both width direction ends of the lower plate 21 downward. A guide piece 22*a* is formed to be integrated with the upper plate 22 by bending one width direction upper end of the upper plate 22 downward so as to prevent the clamping nut not to be tightened further more when the upper plate 22 and the lower plate 21 are stably contacted and a contacting force arrive at a threshold value.

In addition, the clamping bolt 23 is installed to penetrate the lower plate 21 and the upper plate 22 in a direction perpendicular to the plate surface of the lower plate 21 and to be inclined with respect to the insertion unit 10, and the clamping nut 24 is configured to be engaged with the clamping bolt 23 in an inclined direction with respect to the insertion unit 10. At this point, a reinforce unit 22*b* is prominently formed by pressing a lower portion of the upper plate 22 from the bottom surface, and thus strength of the upper plate 22 is improved, and movement of the clamping nut 24 is restricted.

In addition, the bolt fixing piece 21' includes a rotation preventing piece 21*a* for restricting rotation of the clamping bolt 23 and a fixing piece 21*b* bent down from the middle of the rotation piece 21*a* to a position below the clamping bolt 23 to fix the clamping bolt 23.

In addition, a silicon nut formed with a silicon coating layer 24' on the inner surface is used as the clamping nut 24. If such a silicon nut is used, the clamping nut 24 is not easily loosened after being engaged with the clamping bolt 23. Accordingly, the clamping bolt 23 does not need to be damaged so as to be firmly engaged with the clamping nut 24, and durability is improved since the clamping bolt 23 is not corroded.

In addition, a plurality of clamping projections 11 is preferably formed on the inner surface of the insertion unit along the height direction at regular intervals. Accordingly, rotation holding force and retention force of the insertion unit 10 are improved with respect to the post terminal of the storage battery.

In addition, a neck part 15 connecting the insertion unit 10 and the power withdrawal unit 30 is preferably bent to be inclined upward and bent again in the horizontal direction to have a z-bending structure. If the neck part 15 has the z-bending structure as described above, an effect of improving the strength with respect to work hardening can be obtained.

In addition, the power withdrawal unit 30 preferably includes a rotation prevention piece 31, both width direction ends of which are bent downward to prevent rotation of the connection bolt 35, and fixing pieces 32 bent toward from the middle of the rotation prevention piece 31 to the bottom of the connection bolt 35 to support the connection bolt 35. Accordingly, rotation of the connection bolt 35 generated by the vibration of a vehicle or the like can be prevented, and since the connection bolt 35 is tightly fixed, cracks generated when the vehicle vibrates can be prevented, and electrical resistance can be reduced.

In addition, the power withdrawal unit 30 is provided with a bit hole 33 formed by pressing the outer bottom surface of the rotation prevention piece 31 and a position determination projection 34 protruded toward the top surface in correspondence to the bit hole 33 when the bit hole 33 is formed. The position determination projection 34 is inserted into the depression of the connection terminal 40 and fixes the position of the connection terminal 40.

The storage battery connection terminal of the present invention configured as described above couples a clamping nut from an inclined direction, and thus obstructions of other parts of a vehicle can be avoided when a connection work is performed using a clamping tool.

Figure 7:
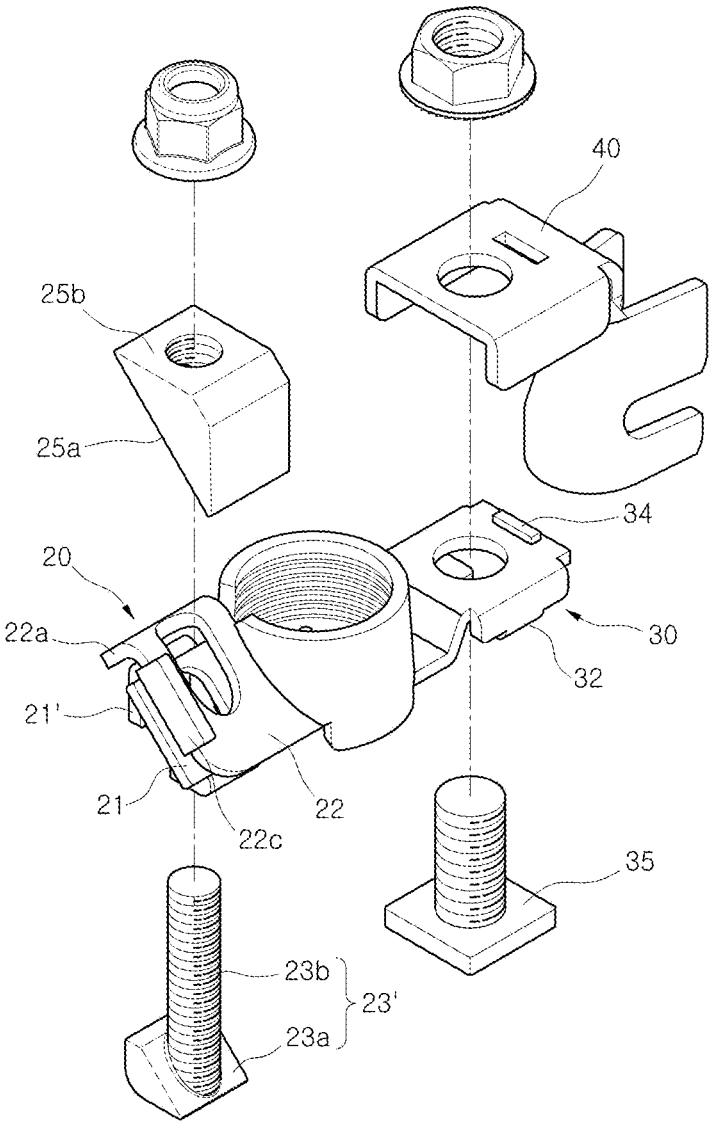
FIG. 7 is an exploded perspective view showing the storage battery connection terminal of FIG. 6.
Figure 8:
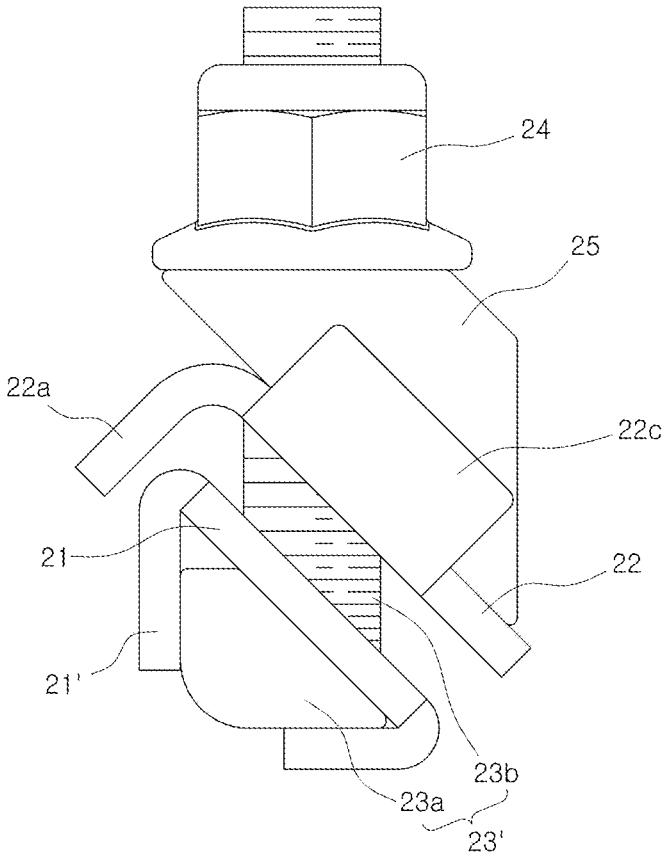
FIG. 8 is a side view showing the clamping unit which is an important part of FIG. 6.

In addition, as shown in FIGS. 7 and 8, the storage battery connection terminal according to another embodiment of the present invention includes an insertion unit 10 formed in the shape of a curved cylinder so that a post terminal of a storage battery may be inserted and combined; a clamping unit 20 formed by extending end portions of the insertion unit 10 toward outside so as to combine or separate the insertion unit 10 to or from the post terminal by adjusting the diameter of the insertion unit 10 as a gap in the clamping unit is changed depending on a position where a clamping bolt 23' and a clamping nut 24 are engaged; and a power withdrawal unit 30 formed to be extended from the other end portion of the insertion unit 10 and provided with a connection bolt 35 to which a connection terminal 40 for withdrawing power to outside is connected.

Here, only the shape of the clamping bolt 23' and the coupling direction of the clamping nut 24 are different from those of the storage battery connection terminal described above, and the structures of the insertion unit 10 and the power withdrawal unit 35 are the same as those of the storage battery connection terminal, and thus the configuration of the other parts except the clamping unit 20 will not be described.

The clamping bolt 23' is installed to be perpendicular to the bottom surface so that the body 23*b* may penetrate the lower plate 21 and the upper plate 22, and the clamping nut 24 is configured to be engaged with the clamping bolt 23' with the intervention of a beveled washer 25 between the upper plate 22 and the clamping nut 24 so that the clamping nut 24 can be engaged with the clamping bolt 23' from a direction perpendicular to the bottom surface. At this point, a washer rotation prevention piece 22*c* formed by bending the end of the upper plate 22 upward prevents departure of the beveled washer 25, and a hole formed at the lower plate 22 and the upper plate 21 to insert the clamping bolt 23' is shaped in a long hole.

In addition, the head 23*a* of the clamping bolt 23' is formed to be inclined so that the bottom surface to which the body 23*b* is connected can be surface-contacted with the bottom surface of the lower plate 21, and the top surface of the head 23*a* is preferably formed as a curved surface so as to be fixed by the bent bolt fixing piece 21'. In addition, the beveled washer 25 is formed such that a portion contacting with the upper plate 22 is formed as an inclined surface 25*a*, and the surface contacting with the clamping nut 24 is formed as a horizontal surface 25*b*.

As the lower surface of the head 23' of the clamping bolt 23' is formed to be inclined and surface-contacts with the bottom surface of the lower plate 21 and the inclined surface 25*a* of the beveled washer 25 surface-contacts with the top surface of the upper plate 21, the clamping nut 25 can be engaged with the clamping bolt 23' from the vertical direction regardless of the upper plate 22 and the lower plate 21 formed to be inclined.

If the clamping nut 24 is engaged with the clamping bolt 23', the beveled washer 25 descends as the clamping nut 24 descends, and the inclined surface 25*a* of the beveled washer 25 applies surface-direction pressure to the upper plate 22. Accordingly, the upper plate 22 descends toward the lower plate 21, and thus the diameter of the insertion unit 10 both ends of which are connected to the upper plate 22 and the lower plate 21 is decreased, and the insertion unit 10 is coupled to the post terminal of the storage battery.

In another embodiment of the present invention configured as described above, a clamping nut can be engaged in a direction perpendicular to the bottom surface, and thus obstructions of other parts of a vehicle can be avoided when a connection work is performed using a clamping tool.

Since there is a limit in clamping, the post terminal of the storage battery can be damaged by applying excessive pressure to the post terminal. However, in the storage battery connection terminal of the present invention, the upper plate and the lower plate are extended from the end portions of the insertion unit to be inclined and disposed in parallel to each other, and thus the post terminal can be prevented from being damaged, and torque management is easy in assembling a vehicle.

In addition, according to the storage battery connection terminal of the present invention, since a silicon coating layer is formed on the inner surface of the clamping nut, the force of coupling to the clamping nut is improved, and the clamping bolt does not need to be damaged to prevent the clamping nut from being loosened, and thus corrosion of the clamping bolt can be prevented, and durability is improved.

In addition, according to the storage battery connection terminal of the present invention, since clamping projections are formed on the inner surface of the insertion unit, holding force and retention force of the insertion unit are improved with respect to the post terminal.

In addition, according to the storage battery connection terminal of the present invention, since the neck part connecting the insertion unit and the power withdrawal unit has a z-bending structure, durability is improved due to increase in hardness with respect to work hardening.

In addition, according to the storage battery connection terminal of the present invention, since the connection bolt is tightly fixed by the rotation prevention piece and the fixing piece formed at the power withdrawal unit, cracks generated by vibration of a vehicle can be prevented, and electrical resistance can be reduced.

In addition, according to the storage battery connection terminal of the present invention, since the position of the connection terminal is determined by inserting the position determination projection formed at the power withdrawal unit into the position determining depression of the connection terminal, the connection terminal is stably combined.

In addition, according to the storage battery connection terminal of the present invention, since the connection bolt is installed in a direction perpendicular to the inclined upper plate, the clamping nut can be engaged from the inclined direction, and thus obstructions of other parts of a vehicle can be avoided when a connection work is performed using a clamping tool.

In addition, according to the storage battery connection terminal of the present invention, since the reinforce unit is prominently formed at the lower portion of the inclined upper plate, downward strength of the upper plate is improved, and movement of the clamping nut is restricted, and thus stable coupling with the clamping bolt can be maintained.

In addition, according to the storage battery connection terminal of the present invention, since the rotation prevention piece prevents rotation of the clamping bolt and the fixing piece fixes the head of the clamping bolt, departure of the clamping bolt is prevented, and the clamping nut is not easily loosened.

In addition, according to the storage battery connection terminal of the present invention, since the body of the clamping bolt is installed in a direction perpendicular to the bottom surface and the clamping nut is also coupled from a direction perpendicular to the bottom surface, obstructions of other parts of a vehicle can be avoided when a connection work is performed using a clamping tool.

In addition, according to the storage battery connection terminal of the present invention, since the lower surface of the head of the clamping bolt is formed to be inclined and surface-contacts with the bottom surface of the lower plate, the body of the clamping bolt can be installed to be perpendicular to the bottom surface.

In addition, according to the storage battery connection terminal of the present invention, since the inclined surface of the beveled washer surface-contacts with the top surface of the extended upper plate and the surface of the beveled washer contacting with the clamping nut is formed as a horizontal surface, the clamping nut can be engaged with the clamping bolt in a direction perpendicular to the bottom surface.

In addition, according to the storage battery connection terminal of the present invention, since the rotation prevention piece is formed at the end portion of the upper plate, departure of the beveled washer can be prevented, and deformation of the insertion unit caused by the beveled washer positioned between the rotation prevention piece and the insertion unit can be prevented.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. In a storage battery connection terminal comprising:

an insertion unit formed in a shape of a curved cylinder so that a post terminal of a storage battery may be inserted and combined;

a clamping unit formed by extending end portions of the insertion unit toward outside so as to combine or separate the insertion unit to or from the post terminal by adjusting a diameter of the insertion unit as a gap in the clamping unit is changed depending on a position where a clamping bolt and a clamping nut are engaged; and a power withdrawal unit formed to be extended from the other end portion of the insertion unit and provided with a connection bolt to which a connection terminal for withdrawing power is connected, wherein the insertion unit, the clamping unit and the power withdrawal unit are manufactured by molding a single panel, the clamping unit includes a lower plate formed to be inclined by extending one end portion of the insertion unit so as to support the clamping bolt, and an upper plate formed to be inclined by extending the other end portion of the insertion unit so as to be disposed in parallel to the lower plate, on which the clamping nut is rested, wherein bolt fixing pieces for fixing the clamping bolt are formed to be integrated with the lower plate by bending both width direction ends of the lower plate downward, and a guide piece is formed to be integrated with the upper plate by bending one width direction upper end of the upper plate downward so as to prevent the clamping nut not to be tightened further more when the upper plate and the lower plate are stably contacted and a contacting force arrive at a threshold value, the clamping bolt is installed to be perpendicular to a bottom surface so that a body of the clamping bolt may penetrate the lower plate and the upper plate, and the clamping nut is engaged with the clamping bolt with intervention of a beveled washer between the upper plate and the clamping nut so that the clamping nut can be engaged with the clamping bolt from a direction perpendicular to the bottom surface.

2. The terminal according to claim 1, wherein a silicon coating layer is formed on an inner surface of the clamping nut.

3. The terminal according to claim 1, wherein a plurality of clamping projections is formed on an inner surface of the insertion unit at regular intervals along a height direction.

4. The terminal according to claim 1, wherein a neck part connecting the insertion unit and the power withdrawal unit is bent to be inclined upward and bent again in a horizontal direction to have a z-bending structure.

5. The terminal according to claim 1, wherein the power withdrawal unit includes rotation prevention pieces, both width direction ends of which are bent downward to prevent rotation of the connection bolt, and fixing pieces bent toward from a middle of the rotation prevention piece to a bottom of the connection bolt to support the connection bolt.

6. The terminal according to claim 5, wherein the power withdrawal unit is further provided with a bit hole formed by pressing an outer bottom surface of the rotation prevention piece and a position determination projection protruded toward a top surface in correspondence to the bit hole.

7. The terminal according to claim 1, wherein the clamping bolt is installed to penetrate the lower plate and the upper plate in a direction perpendicular to a plate surface of the lower plate and to be inclined with respect to the insertion unit, and the clamping nut is engaged with the clamping bolt in an inclined direction with respect to the insertion unit, wherein a reinforce unit is prominently formed from a lower portion of the upper plate toward the top surface of the upper plate to improve strength of the upper plate and restrict movement of the clamping nut.

8. The terminal according to claim 7, wherein the bolt fixing piece includes a rotation preventing piece for restricting rotation of the clamping bolt and a fixing piece bent down from a middle of the rotation piece to a position below the clamping bolt to fix the clamping bolt.

9. The terminal according to claim 1, wherein a head of the clamping bolt is formed to be inclined so that a bottom surface to which the body is connected can be surface-contacted with a bottom surface of the lower plate, and a top surface of the head is formed as a curved surface so as to be fixed by the bent bolt fixing piece, wherein the beveled washer is formed such that a portion contacting with the upper plate is formed as an inclined surface, and a surface contacting with the clamping nut is formed as a horizontal surface.

10. The terminal according to claim 1, further comprising a washer rotation prevention piece formed by bending an end of the upper plate upward to prevent departure of the beveled washer.

* * * * *